US006843063B2

(12) United States Patent
Miwa

(10) Patent No.: US 6,843,063 B2
(45) Date of Patent: Jan. 18, 2005

(54) METHOD AND DEVICE FOR SAVING ENERGY IN INDOOR COOLING AND HEATING

(76) Inventor: Kazuo Miwa, 26-2, Omorinishi 5-chome, Ota-ku, Tokyo 143-0015 (JP)

( * ) Notice: Subject to any disclaimer, the term of this patent is extended or adjusted under 35 U.S.C. 154(b) by 0 days.

(21) Appl. No.: 10/297,677

(22) PCT Filed: Jun. 8, 2000

(86) PCT No.: PCT/JP01/04850

§ 371 (c)(1),
(2), (4) Date: Dec. 9, 2002

(87) PCT Pub. No.: WO01/94854

PCT Pub. Date: Dec. 13, 2001

(65) Prior Publication Data

US 2004/0020222 A1 Feb. 5, 2004

(30) Foreign Application Priority Data

Jun. 8, 2001 (JP) ..... 2000-171661

(51) Int. Cl.[7] ..... F24F 7/06
(52) U.S. Cl. ..... 62/89; 62/262; 454/231
(58) Field of Search ..... 62/89, 262; 454/231

(56) References Cited

U.S. PATENT DOCUMENTS 4,053,732 A * 10/1977 Carter ..... 392/358
4,184,415 A * 1/1980 Nicholson ..... 454/231
4,945,820 A * 8/1990 Fukuda ..... 454/231
5,012,973 A * 5/1991 Dick et al. ..... 236/46 R
5,042,366 A * 8/1991 Panetski et al. ..... 454/231
5,228,306 A * 7/1993 Shyu et al. ..... 62/176.6
6,209,335 B1 * 4/2001 Nowaczyk ..... 62/229

FOREIGN PATENT DOCUMENTS

JP 61-213532 9/1986
JP 07-243680 9/1995

* cited by examiner

*Primary Examiner*—William E. Tapolcai
(74) *Attorney, Agent, or Firm*—Wenderoth, Lind & Ponack, L.L.P.

(57) ABSTRACT

Energy saving in indoor air conditioning is achieved by combining indoor air vertical convection producing means and indoor air conditioning means. A fan for performing suction and exhaust of air for vertically circulating the indoor air through suction and exhaust ports provided on upper and lower parts of a room is operated or stopped according to a difference in temperatures detected on the upper and lower parts of the room. The output of the fan at the time of operation is increased or decreased according thereto to prevent energy loss occurring when warm air accumulates on the upper part and cool air accumulates on the lower part. The operation or suspension of an air conditioner installed indoors, and the amount of energy consumed at the time of operating the air conditioner is controlled depending on a difference between a temperature detected in the room and a preset indoor temperature.

7 Claims, 8 Drawing Sheets

METHOD AND DEVICE FOR SAVING ENERGY IN INDOOR COOLING AND HEATING

TECHNICAL FIELD

The present invention relates to a method and apparatus for saving energy in indoor air conditioning so as to reduce as much energy loss as possible for indoor air conditioning in, for example, ordinary houses, offices, stores, assembly halls, public office buildings, schools, hospitals, factories and greenhouses.

BACKGROUND ART

Conventional air conditioners are normally operated or stopped when the indoor temperature that is detected by a temperature sensor provided in a suitable place in a room (for example, near the air conditioner) has reached a preset indoor temperature. Therefore, it is known that a loss of energy occurs even when the indoor temperature that is detected by the temperature sensor has reached the set indoor temperature because, if heating is continued, the temperature on or near the ceiling becomes higher than the set indoor temperature, and if cooling is continued, the temperature on or near the floor becomes lower than the set indoor temperature.

Therefore, in order to solve the above-described loss of energy, detecting a difference in the upper and lower temperatures in the room, and stirring the indoor air when the temperature difference exceeds a set value has been proposed (Japanese Patent Application Laid-Open (JP-A) No. 5-180459).

According to this known invention, since the temperature difference between the upper part and the lower part of the room is detected and a convection is generated in the room, the loss of energy in air conditioning caused by high-temperature air accumulating near the ceiling and low-temperature air accumulating in the vicinity of the floor can be improved. However, energy saving by using this process together with the conventional air conditioner has not been taken into consideration. Moreover controlling the power that is supplied to a fan for generating the convection in the room based on the size of the temperature difference between the upper part and the lower part of the room has also not been taken into consideration. Furthermore, controlling the feed rate of energy (for example, the quantity of power, gas, fuel oil or the like) to the air conditioner that is installed in the room has also not been taken into consideration.

When the indoor space is large (for example, in offices, stores, assembly halls, public office buildings, schools, hospitals, factories, greenhouses, etc.), it is necessary to provide a large number of air supply and exhaust openings so as to generate the convection in the indoor air. However, the opening and closing control of the large number of air supply and exhaust openings or the control of a flow rate at the time of supplying or exhausting the air has not been suggested at all.

SUMMARY OF THE INVENTION

An object of the present invention is to save energy in indoor air conditioning by combining indoor air vertical convection producing means with indoor air conditioning means.

In other words, in the present invention, a fan for performing suction and exhaust of the air for vertically circulating the indoor air through suction and exhaust ports that are provided on upper and lower parts in a room is operated or stopped according to a difference in temperatures that are detected on the upper and lower parts of the room, and the output of the fan during operation is increased or decreased according thereto so as to prevent a loss of energy that is caused by warm air accumulating on the upper part in the room and cool air accumulating on the lower part in the room.

Further, according to the present invention, the operation or suspension of an air conditioner that is installed indoors, and the amount of energy that is consumed at the time of operating the air conditioner is controlled depending on a difference between a temperature that is detected in the room and a preset indoor temperature.

By combining the indoor air vertical convection producing means and the indoor air conditioning means, the room temperature can be controlled efficiently with less energy consumption.

That is, with an energy saving method in indoor air conditioning which is proposed by the present invention, air is sucked or exhausted from the upper part and the lower part of the room according to a temperature difference between the temperature on the upper part of the room and the temperature on the lower part of the room so as to vertically circulate the indoor air. Further, the air conditioner that is equipped in the room is operated or stopped according to a temperature difference between the indoor temperature and the preset indoor temperature.

For example, the respective temperatures on the upper part and the lower part of the room are compared with each other, and when a temperature difference between those temperatures becomes a predetermined set temperature difference, air is sucked or exhausted from the upper part and the lower part of the room so as to vertically circulate the indoor air, and when the indoor temperature is compared with the preset indoor temperature and there is a temperature difference, the air conditioner that is equipped in the room is operated or stopped.

By vertically circulating the indoor air by sucking or exhausting the air from the upper part and the lower part of the room, the temperature difference between the upper part and the lower part of the room is suppressed to the predetermined set temperature difference or therebelow, and a loss of energy which is caused by warm air accumulating on the upper part in the room and cool air accumulating on the lower part in the room can be prevented.

In this manner, the temperature difference between the upper part and the lower part of the room is suppressed to the predetermined set temperature difference or therebelow. Further, the indoor temperature is compared with the preset indoor temperature, and the air conditioner equipped in the room is operated or stopped only when there is a temperature difference between the indoor temperature and the preset indoor temperature, thereby enabling an efficient control of the room temperature with less energy consumption.

The temperature on the upper part of the room is detected at one point or at a plurality of points near the ceiling, and the temperature on the lower part of the room is detected at one point or at a plurality of points near the floor.

Moreover, the suction rate or exhaust rate of air from the upper and lower parts of the room can be increased or decreased based on the size of a difference between (1) the detected temperature difference between the upper part and the lower part of the room and (2) the set temperature difference, and the amount of energy that is consumed for the operation of the air conditioner can be increased or decreased based on the size of a difference between the detected indoor temperature and the set indoor temperature.

For example, when a difference between (1) the detected temperature difference between the upper part and the lower part of the room and (2) the set temperature difference is large, the suction rate or the exhaust rate of the air from the upper part and the lower part of the room is increased so as to increase the speed of the vertical convection of air caused in the room. As a result, the temperature difference between the upper part and the lower part of the room can be efficiently suppressed to the predetermined set temperature difference or therebelow. On the other hand, when the above difference is small, even if the suction rate or the exhaust rate of the air from the upper part and the lower part of the room is decreased to reduce the speed of the vertical convection of air caused in the room, since the above difference is small, it is easy to suppress the temperature difference between the upper part and the lower part of the room to the predetermined set temperature difference or therebelow. Therefore, in this manner, room temperature can be efficiently adjusted while suppressing the amount of energy consumption.

When there is a difference between the detected indoor temperature and the set indoor temperature and the air conditioner is to be operated, the amount of energy that is consumed for the operation of the air conditioner, more specifically, the amount of power to be supplied, or the amount of gas or fuel oil that is consumed for the operation of the air conditioner is increased or decreased depending on the size of the difference between the detected indoor temperature and the set indoor temperature. As a result room temperature can be efficiently adjusted while suppressing the amount of energy consumption.

Further, suction or exhaust of air from the upper and lower parts of the room may be respectively carried out at a plurality of points on the upper and lower parts of the room, detection of the temperature on the upper and lower parts of the room may be performed at the plurality of suction or exhaust points of the air, and the suction rate or the exhaust rate of the air may be increased or decreased at the plurality of respective points where the suction or exhaust of air is being carried out.

As a result, even when the indoor space is large (for example, in offices, stores, assembly halls, public office buildings, schools, hospitals, factories, greenhouses, etc.), vertical convection can be produced in the indoor air, and a vertical temperature difference in such a large indoor space can be eliminated efficiently.

A second aspect of the present invention is an energy saving apparatus in indoor air conditioning which comprises indoor air vertical convection producing means (unit) and indoor air conditioning means (unit) respectively having a construction as described below.

The indoor air vertical convection producing means comprises air suction and exhaust ports respectively provided on the upper and lower parts of the room, respectively; a duct for connecting the suction and exhaust ports; a fan placed in the intermediate position of the duct, where the fan can change over the air blasting direction; first and second temperature sensors for detecting the temperature on the upper part and the temperature on the lower part of the room, respectively; and a first control unit which receives the input from the first and second temperature sensors and controls the operation of the fan according to the temperature difference between the upper part and the lower part of the room.

For example, control of the first control unit is carried out in such a manner that when the temperatures on the upper part and the lower part of the room are compared and the temperature difference therebetween exceeds a predetermined set temperature difference, the fan is operated so as to suck or exhaust air from the upper part and the lower part of the room to thereby vertically circulate the indoor air. On the other hand, when the temperature difference therebetween falls below the predetermined set temperature difference, the operation of the fan is stopped.

The indoor air conditioning means comprises: an air conditioner equipped in the room; a third temperature sensor for detecting the indoor temperature; and a second control unit which receives the input from the third temperature sensor and controls the operation of the air conditioner according to the indoor temperature.

For example, when the indoor temperature that is detected by the third temperature sensor is compared with the predetermined set indoor temperature and there is a temperature difference therebetween, control of the second control unit is carried out so as to operate or stop the air conditioner equipped in the room.

In the apparatus of the present invention described above, the configuration may be such that a plurality of the above-described structures are provided. For instance, air suction and exhaust ports are respectively provided on the upper and lower parts of the room, and a duct for connecting the suction and exhaust ports having a fan that can change over the air blasting direction placed in the intermediate thereof is installed at a plurality of points in the room. Further, the first and second temperature sensors for respectively detecting the temperature on the upper part and the temperature on the lower part of the room are provided for each structure so that the operation of the fan is controlled by the first control unit for each fan in the plurality of structures.

In this manner, even when the indoor space is large (for example, in offices, stores, assembly halls, public office buildings, schools, hospitals, factories, greenhouses, etc.), vertical convection can be produced in the indoor air, and a vertical temperature difference in such a large indoor space can be eliminated efficiently.

In the present invention as described above, when the upper and lower suction and exhaust ports are connected by the duct and the fan is placed in the duct, the apparatus can be one which is installed indoors. Moreover, when a house is newly built, a duct having a fan placed therein can be accommodated under the roof.

Furthermore, the present invention can be employed in assembly halls, schools, hospitals, public office buildings, factories, greenhouses, etc. (that is, in a place having a wide indoor space) as well as in ordinary houses regardless of the size of the indoor space. In the case of a wide indoor space, the apparatus can be designed in an efficient system such that the suction and exhaust ports and the temperature sensors are arranged in a plurality of points, and the opening or closing of the suction and exhaust ports is separately controlled.

In the present invention, not only is energy saved by taking a balance of temperature between the upper and lower parts of the room, but also the amount of power that is used for the fan, and the energy source, such as power, gas or fuel oil that is used for the air conditioner can be reduced, and therefore, the energy can be saved comprehensively. According to experiments in ordinary houses, energy saving of about 30% can be recognized by applying the present invention.

In the present invention, since air is circulated inside the duct in order to vertically circulate the indoor air, such circulation can be used for cleaning of the air (by allowing air to pass through a filter), for adjusting the humidity or for sterilization. Particularly, the removal of $NO_2$, $CO_2$ or other harmful gases and the positive improvement of the air, such as mixing negative ions, can be easily performed.

The present invention is constructed such that temperatures on the upper and lower parts of the room are measured so as to drive the fan depending on the temperature difference therebetween. Air is sucked or exhausted from suction and exhaust ports provided on the upper and lower parts of the room so as to vertically circulate the indoor air to thereby eliminate (or reduce) the temperature difference between the upper part and the lower part in the indoor temperature. Further, the air conditioner and the fan are operated with less energy in order to adjust the indoor temperature to a preset indoor temperature.

The driving of the fan and the operation of the air conditioner are performed automatically and with less energy, for example, by placing an inverter in a circuit, or the like.

The apparatus of the present invention is independently installed indoors, or the apparatus is installed on the wall or under the roof at the time a new building is constructed. Therefore, needless to say, the apparatus of the present invention can be newly installed, and further, the apparatus can be used together with an existing air conditioner, or the existing air conditioner can be slightly modified and used. The method of the present invention can be employed in ordinary houses having a small indoor capacity, or in, for example, assembly halls, schools, hospitals, public office buildings, factories or greenhouses having a large capacity.

According to the present invention, when the temperature difference between the upper part and the lower part of the room exceeds a predetermined set temperature difference, vertical air convection is produced in the room so as to make the indoor temperature uniform on the upper and lower parts of the room. Moreover, the actual room temperature at this time is compared with the predetermined set room temperature, so as to adjust the room temperature. As a result, there is a large energy savinq effect.

Furthermore, an energy saving operation is carried out by increasing or decreasing the operation output of the fan and the air conditioner depending on the size of the temperature difference. As a result, there is a large energy saving effect as a whole.

DETAILED DESCRIPTION OF THE INVENTION

First Embodiment

An energy saving apparatus in indoor air conditioning according to a first embodiment of the present invention will be described with reference to FIGS. 2 and 3.

Figure 2:
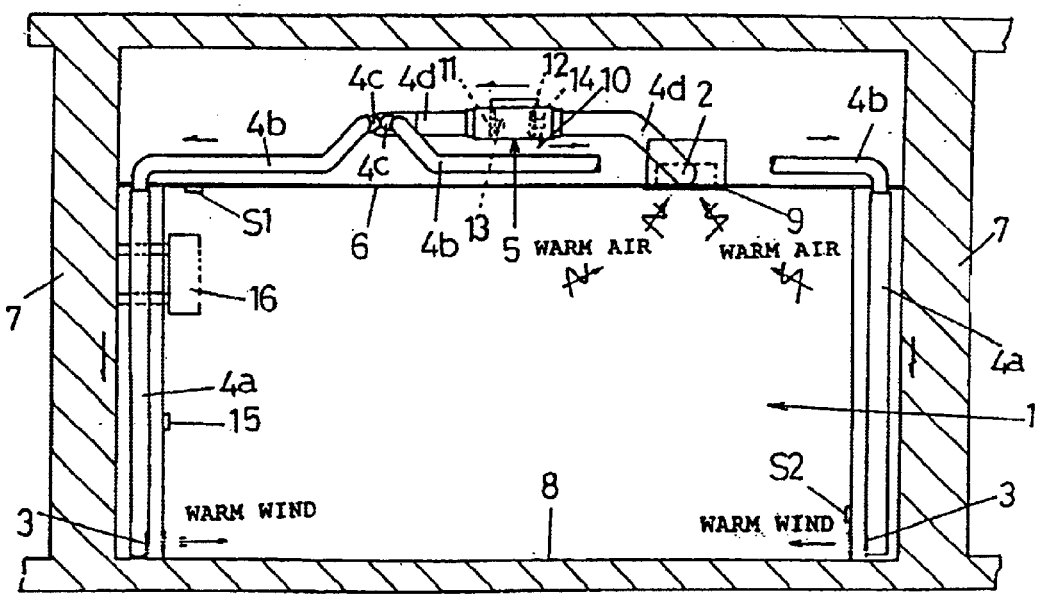
FIG. 2 is an elevational view for explaining the construction of a first embodiment of the apparatus according to the present invention.
Figure 3:
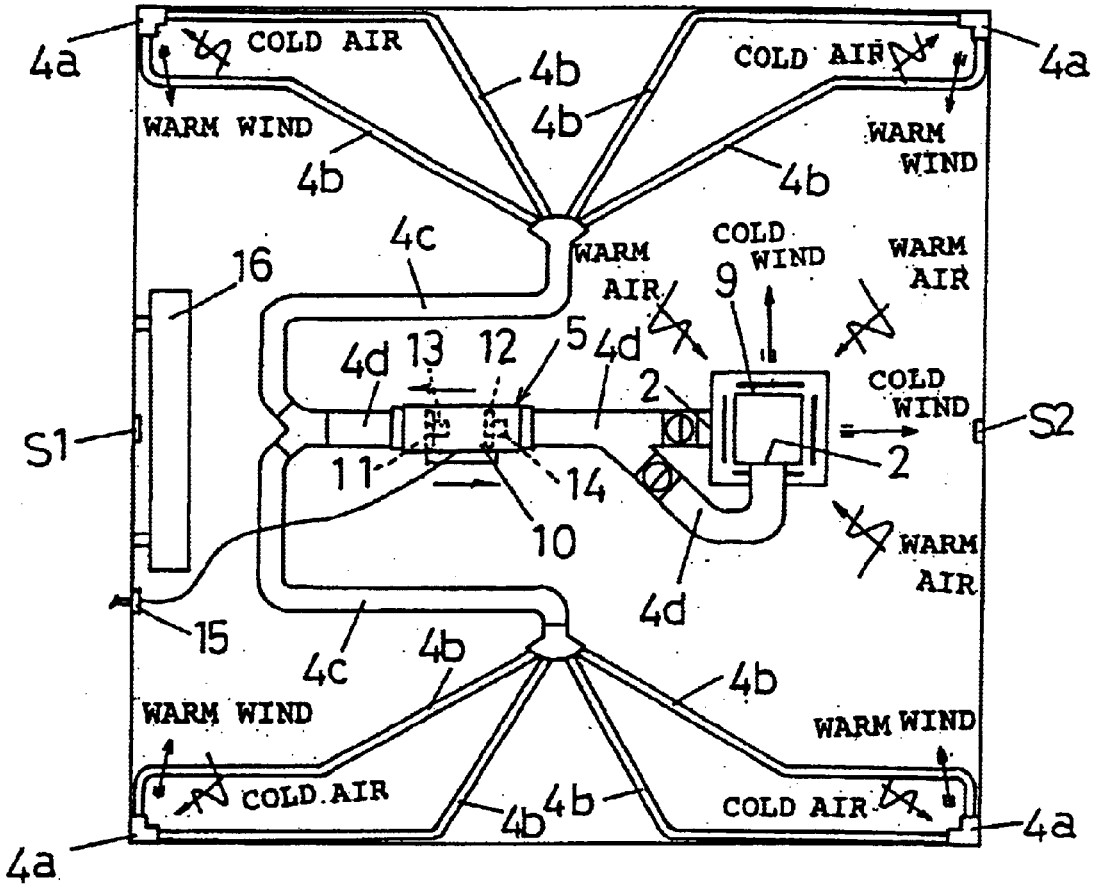
FIG. 3 is a plan view of FIG. 2.

FIG. 2 is an elevational view showing the state in which an example of the apparatus according to the present invention is provided on a ceiling 6 and walls 7 in a room 1, and FIG. 3 is a plan view thereof.

As shown in FIGS. 2 and 3, ducts 4*a*, 4*a*, 4*a*, 4*a* are arranged in a standing condition along the walls 7 at the four corners of the room in a building, and a suction and exhaust port 3 for the lower air is respectively provided at the lower part of each duct 4*a*, where the suction and exhaust part 3 faces indoors in the vicinity of the floor 8.

The upper ends of the respective ducts 4*a*, 4*a*, 4*a*, 4*a* provided at the four corners of the room protrude to the upper side of the ceiling 6. The upper ends of the respective ducts 4*a*, 4*a*, 4*a*, 4*a* are connected to collecting ducts 4*c*, 4*c* provided on the opposite sides via a plurality of branched ducts 4*b*, on the upper side of the ceiling 6, and the opposite collecting ducts 4*c* are connected to a main duct 4*d* which is provided in the middle of the ceiling 6.

A fan 5 is placed in the middle of the main duct 4*d*. An open end of the main duct 4*d* is connected to a suction and exhaust grill 9, which is set on the ceiling 6. A suction and exhaust port 2 for the upper air is provided in the suction and exhaust grill 9.

A filter is detachably provided in the suction and exhaust port 2 in the suction and exhaust grill 9 which allows for dust and dirt in the room are forcibly removed so as to supply clean air to the room.

In FIGS. 2 and 3, ducts 4*a* to 4*d* are used as ducts for both warm air and for cold air. The lower suction and exhaust port 3 serves as a suction port and an exhaust port, and the upper suction and exhaust port 2 serves as a suction port and an exhaust port depending on the rotation direction of the fan 5.

For the fan 5, a blower (fan) for ducts is used, which is of a type that performs normal rotation and reverse rotation by switching control. For this blower for ducts, a normal single propeller blower may be used, a so-called counter rotation blower, which realizes low noise, may be used.

The counter rotation blower shown in FIGS. 2 and 3 is a counter-rotating blower, and the structure thereof is such that a first propeller 11, which rotates in the air blasting direction, and a second propeller 12, which rotates in the opposite direction and which is spaced away from the first propeller 11 in the axial direction, are provided inside a cylindrical case 10 that is connected to the middle of the main duct 4*d*. By rotating motors 13, 14 which are provided in the propellers 11 and 12, respectively, the rotational flow by the first propeller 11 is rectified to the axial flow by the second propeller 12, and the rotational energy is converted into pressure energy. As a result, highly efficient static pressure can be obtained.

As shown in FIG. 2, an upper temperature sensor S1, which is a first temperature sensor that is provided on the upper part of the room, is provided on the ceiling 6 side, and a lower temperature sensor S2, which is a second temperature sensor that is provided on the lower part of the room, is provided on the wall near the floor 8.

One of each of the upper temperature sensor S1 and the lower temperature sensor S2 may be provided on the ceiling 6 side and on the floor 8 side, or a plurality of the upper and lower temperature sensors S1 and S2 may be provided on the ceiling 6 side and the floor 8 side. The arranged number thereof can be adjusted according to the size of the indoor space and the number of the suction and exhaust ports 2 for the upper air and the number of the suction and exhaust ports 3 for the lower air.

The fan 5, the upper temperature sensor S1 and the lower temperature sensor S2 are respectively connected to a controller 15, which is a first control unit, by wiring (not shown).

The controller 15 has a fan circuit having the control structure described below so as to enable the following control. One is a control for operating or stopping the fan 5, respectively, when a difference between the upper temperature and the lower temperature of the room which are actually detected by the upper temperature sensor S1 and the lower temperature sensor S2, respectively, exceeds or falls under a predetermined set temperature difference. The other control is for controlling the size (strength) of the operation output of the fan 5 depending on the amount of difference between (1) the difference between the upper temperature and the lower temperature of the room which are actually detected by the upper temperature sensor S1 and the lower temperature sensor S2, respectively, and (2) the predetermined set temperature difference.

The controller 15 may perform switching by remote control.

The control structure of the fan circuit in the controller 15 will now be described with reference to FIG. 6A. A relay coil A is connected to a vertical temperature detector, to which the upper temperature sensor S1 and the lower temperature sensor S2 are connected, and the relay coil A, the upper temperature sensor S1 and the lower temperature sensor S2 are connected to a power source (DC24V). When the temperature difference which is detected by the upper temperature sensor S1 and the lower temperature sensor S2 exceeds the predetermined set temperature difference, electric current flows into the relay coil A so as to close a contact point a1. In other words, the contact point a1 is turned ON. On the other hand, when the temperature difference which is detected by the upper temperature sensor S1 and the lower temperature sensor S2 falls below the predetermined set temperature difference, electric current does not flow into the relay coil A so as to thereby open the contact point a1. In other words, the contact point a1 is turned OFF.

Moreover, the contact point a1 is connected to a fan motor FM that rotates the fan 5 (for example, the contact point a1 is connected to the electric circuit of the fan 5 via an inverter), and a make and break of the electric current of the power source (AC100V) is carried out at the contact point a1, as described above. As a result, when the contact point a1 is closed (that is, turned ON), the motor FM of the fan 5 rotates, and the motor FM of the fan 5 stops when the contact point a1 is opened (that is, turned OFF).

The indoor air vertical convection producing means (unit) is formed according to the above-described construction.

On the other hand, an air conditioner 16 is installed on the indoor wall. The air conditioner 16 is generally available in the market, and the air-conditioner 16 blows cold air or warm air indoors depending on the input signal. The air conditioner 16 is connected to the electric circuit of the fan 5 described above (for example, the air conditioner 16 is connected to the circuit via an inverter).

Figure 6:
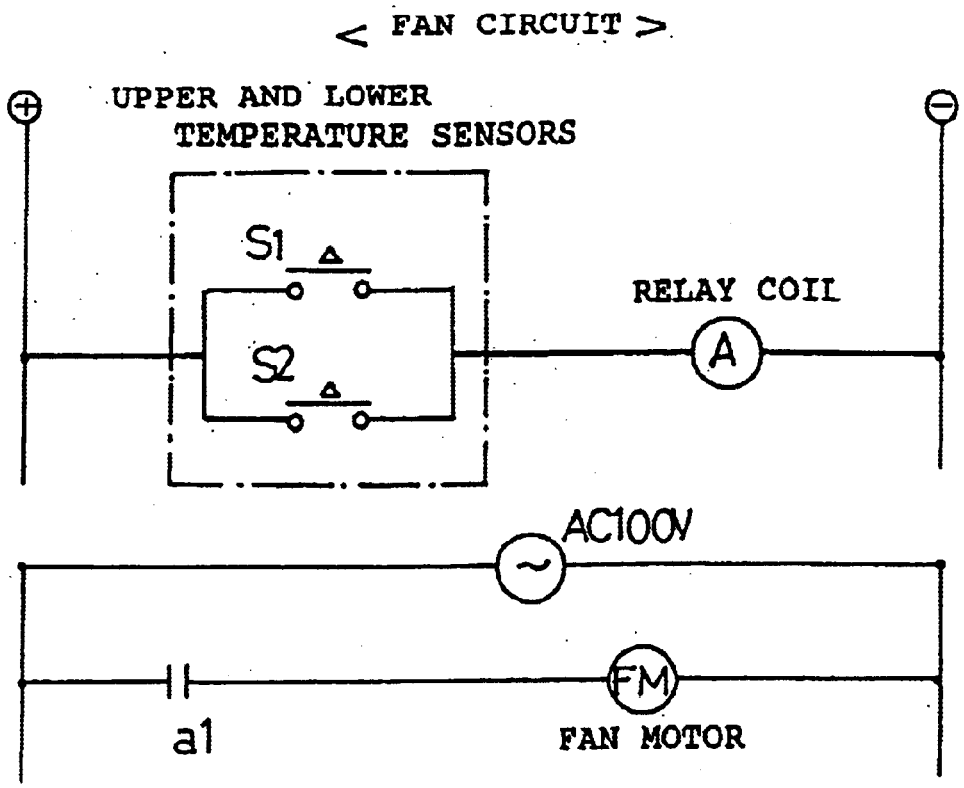
FIG. 6A is a diagram showing an electric circuit of a fan.
FIG. 6B is a circuit diagram of an air conditioner.
Figure 6:
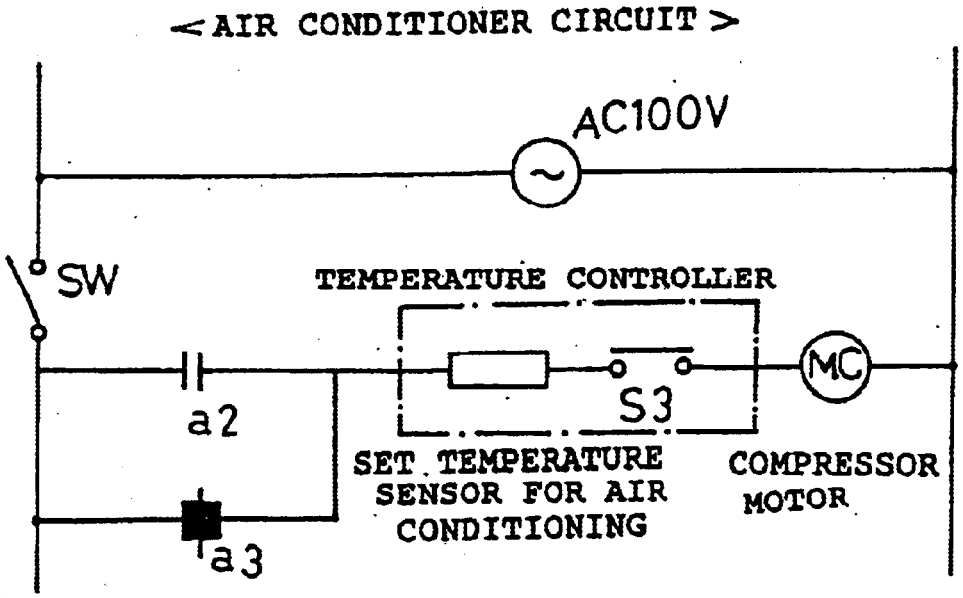

The electric air conditioning circuit of the air conditioner 16 is such that, as shown in FIG. 6B, a contact point a2 is connected with a contact point a3 via an air conditioner operation switch SW which is connected to the power source (AC100V), and a compressor motor MC is further connected thereto via a temperature controller having an air conditioner set temperature sensor S3. In other words, an electric air conditioner circuit such as the one shown in FIG. 6B corresponds to a second control unit which controls the operation and suspension of the air conditioner 16. The air conditioner set temperature sensor S3 corresponds to a third temperature sensor for detecting indoor temperature.

The indoor air conditioning means (unit) is formed according to the above-described construction.

For example, when the fan motor FM in the fan circuit is turned ON, the compressor motor MC operates by means of the contact point a2, and when the fan motor FM in the fan circuit is turned OFF, the compressor motor MC operates by means of the contact point a3.

By having such a construction, when, for example, the air conditioner 16 is set as a heating means (heater) and if the air conditioner operation switch SW is turned ON (manually), the compressor motor MC is stopped by the temperature controller. Further when, for example, the indoor temperature which is detected by the air conditioner set temperature sensor S3 has reached the predetermined set indoor temperature and if the indoor temperature does not reach the set temperature, the compressor motor MC is operated by the temperature controller.

Therefore, in the temperature controller (second control unit) in the air conditioner circuit, if, for example, the predetermined set indoor temperature is 26° C., the air conditioner 16 operates until the air conditioner set temperature sensor S3 senses 26° C.

On the other hand, the fan 5 continues to operate until there is no temperature difference in the temperature detection results of the upper temperature sensor S1 and the lower temperature sensor S2, which sense the upper temperature and the lower temperature in the room, respectively. As a result, the indoor temperature can be maintained at 26° C. vertically uniformly such that there is little temperature difference between the upper and lower parts of the room.

In other words, the air conditioner 16, being set as a heating means (heater) in the wintertime, operates, until the temperature sensor S3 on the air conditioner circuit side (the third temperature sensor) senses, for example, 26° C., which is the set indoor temperature. At this time, the fan 5 is rotated so as to blow air from the ceiling 6 side to the floor 8 side to thereby suck warm air that has accumulated in the upper part of the room from the suction and exhaust port 2 on the ceiling 6 side and exhaust the accumulated warm air from the suction and exhaust ports 3 on the floor 8 side as warm wind. As a result, the floor 8 side can be efficiently warmed so as to make the indoor temperature uniform as a whole.

Also the air conditioner 16, being set as a cooling means (unit) in the summertime, operates until the temperature sensor S3 on the air conditioner circuit side (the third temperature sensor) senses, for example, 22° C., which is the set indoor temperature. At this time, the fan 5 is rotated so as to blow air from the floor 8 side to the ceiling 6 side to thereby suck cool air that has accumulated in the lower part of the room from the suction and exhaust ports 3 on the floor 8 side and exhaust the accumulated cool air from the suction and exhaust port 2 on the ceiling 6 side as cold wind. As a result, the floor 6 side can be efficiently cooled so as to make the indoor temperature uniform as a whole.

An inverter (not shown) is built in the circuit of the fan motor FM (FIG. 6A), in the electric air conditioning circuit of the air conditioner 16 (FIG. 6B), in the circuit of the compressor motor MC and the like. As a result, the fan 5 and the air conditioner 16 are fully operated or operated at a reduced speed to save energy, respectively, depending on the size of a difference between (1) the difference between the upper temperature and the lower temperature which are actually detected by the upper temperature sensor S1 and the lower temperature sensor S2, respectively, and (2) the predetermined set temperature difference, and depending on the size of a difference between the indoor temperature which is actually detected by the temperature sensor S3 (the third temperature sensor) and the predetermined set indoor temperature.

In the above-described construction, it is more preferable for controlling the temperature while keeping the indoor temperature vertically uniform if the construction is such that the air conditioner temperature sensor S3 that is provided in the air conditioner 16 is connected to the upper temperature sensor S1 and the lower temperature sensor S2 so that even when there is no temperature difference between the upper part and the lower part of the room, the fan 5 is rotated upon operation of the air conditioner when the air conditioner temperature sensor S3 has not reached the set temperature.

The fan 5 shown in FIGS. 2 and 3 can be used both as the duct 4 for warm wind and the duct 4 for cold wind. However, the indoor air vertical convection producing means shown in FIGS. 4 and 5 has a construction which is suitable for a relatively large indoor space by separately providing a duct for warm wind and a duct for cool wind.

Figure 5:
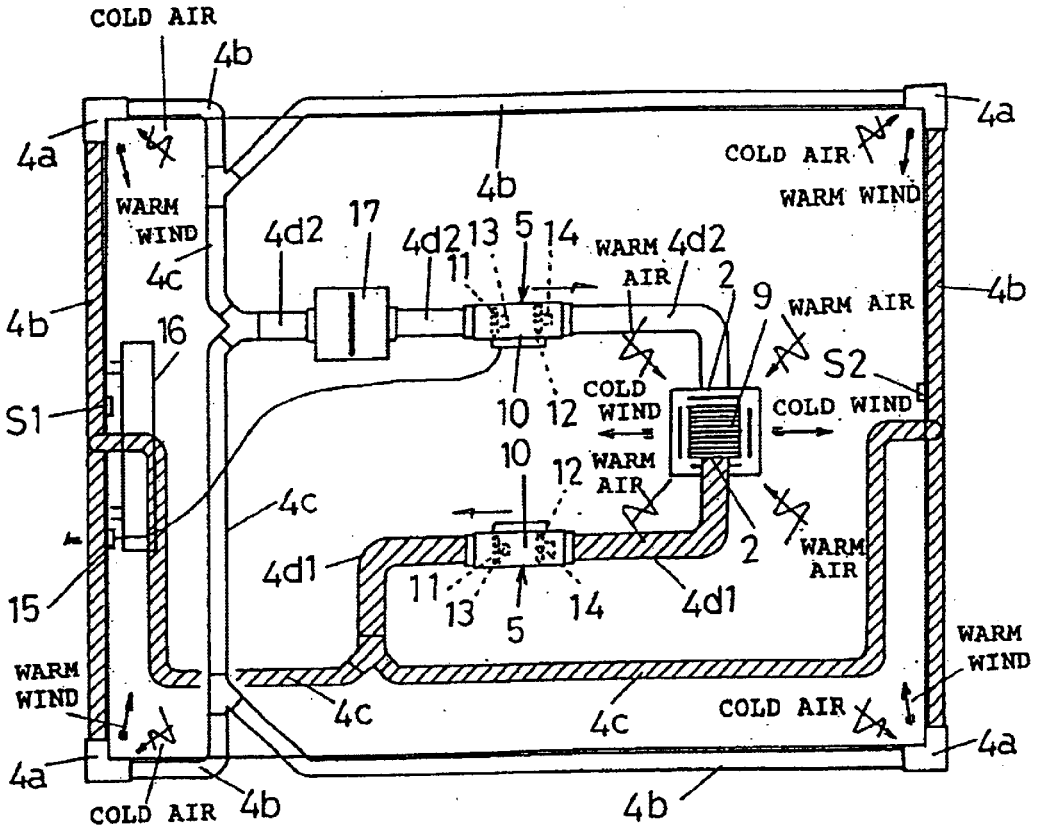
FIG. 5 is a plan view of FIG. 4.

That is to say, this construction is the same as the above-described construction in which ducts 4*a*, 4*a*, 4*a*, 4*a* are arranged in a standing condition along the walls 7 at the four corners of the room. However, as shown in FIG. 5, the respective ducts 4*a*, 4*a*, 4*a*, 4*a* are connected to branched ducts 4*b*, 4*b*, 4*b*, 4*b* at the upper ends so as to connect the four sides. The branched ducts 4*b*, 4*b*, 4*b*, 4*b* are connected to collecting ducts 4*c*, 4*c* on the opposite sides, respectively, in the middle thereof. Moreover, the opposite collecting ducts 4*c*, 4*c*, 4*c*, 4*c* are connected to a main duct 4*d*1 for warm wind and a main duct 4*d*2 for cold wind. A fan 5 is respectively provided in the main ducts 4*d*1 and 4*d*2. The open end of each main duct 4*d*1, 4*d*2 is connected to a suction and exhaust grill 9 set on the ceiling 6. As a result, the duct 4*d*1 on the side shown by oblique lines is designated as a duct which is exclusively for warm wind, and the other duct 4*d*2 is designated as a duct which is exclusively for cold wind.

Figure 1:
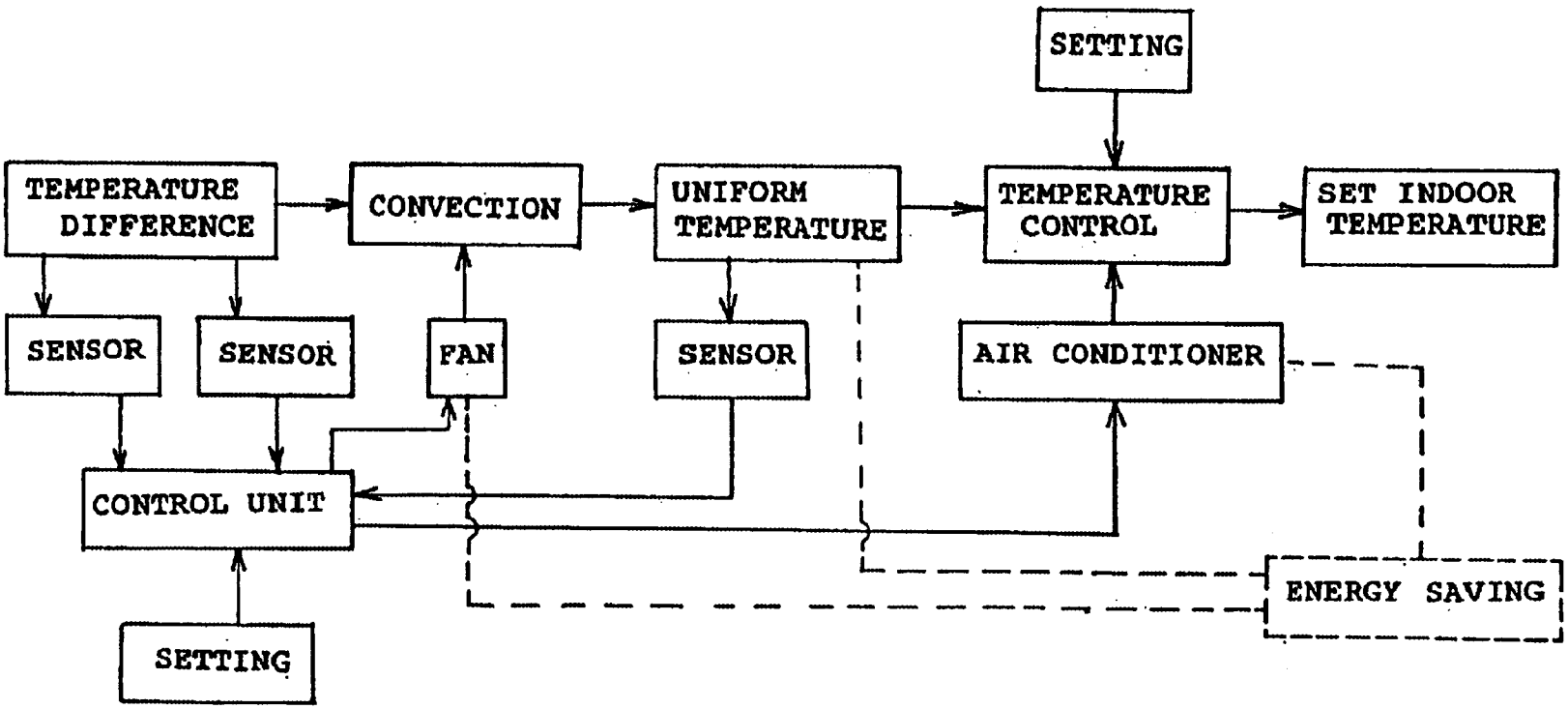
FIG. 1 is a block diagram for explaining an operating process in a method of the present invention.
Figure 4:
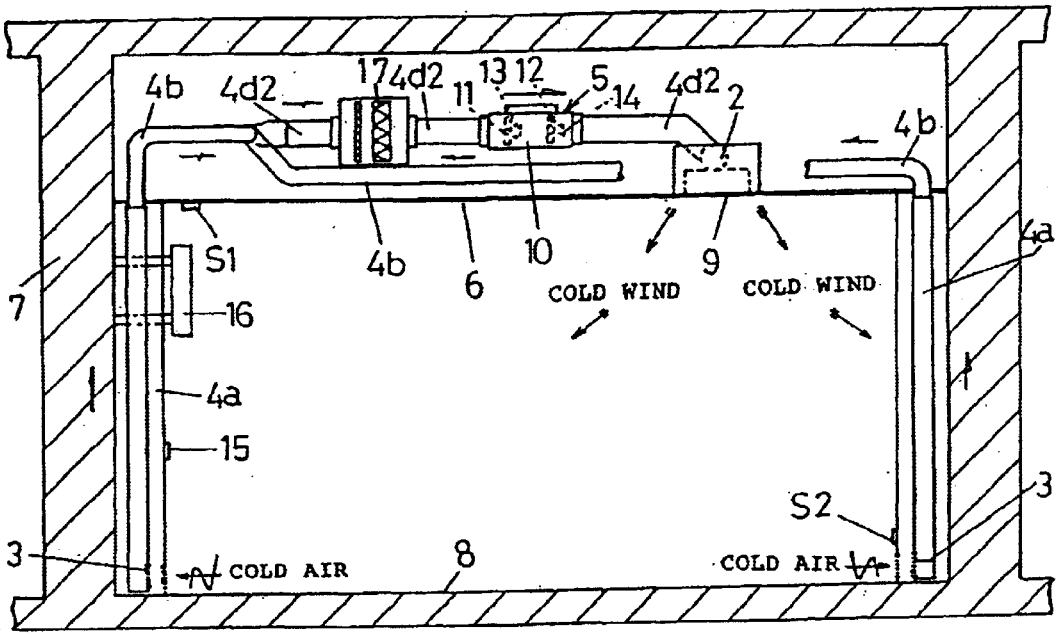
FIG. 4 is an elevational view for explaining the construction of a second embodiment of the apparatus according to the present invention.

Another construction is the same as the embodiment shown in FIGS. 1 and 2, but in the duct construction shown in FIGS. 4 and 5, the rotation direction of the respective fans 5, 5 can be fixed for both in the wintertime and the summertime. Also, in the duct construction shown in FIGS. 4 and 5, a large filter 17 is provided in the middle of the main duct 4*d*2 in addition to the filter that is provided in the suction and exhaust grill 9.

Second Embodiment

A second embodiment of the present invention, which is an energy saving method in indoor air conditioning according to the present invention and which uses the energy saving apparatus in indoor air conditioning of the first embodiment of the present invention described above with reference to FIGS. 2 through 4, will be described, with reference to FIG. 1.

The output of the two temperature sensors respectively installed on the upper part (near the ceiling) and on the lower part (near the floor) of the room is input to the first control unit. When a temperature difference between the two temperature sensors has reached the set temperature difference (for example, 1° C.), the first control unit outputs an instruction to the fan 5 to drive the fan 5. As a result, the air in the ducts 4*a* connecting the suction and exhaust ports 2 and 3 that are provided on the upper part and the lower part of the room is made to flow upwards or downwards. For example, at the time of heating, the fan 5 rotates so as to shift the high-temperature air on the ceiling side of the room towards the floor side.

When it is assumed that the predetermined set indoor temperature is 20° C., that temperature control is to be carried out towards this set indoor temperature, that the temperature sensor on the ceiling side detects 18° C., and that the temperature sensor on the floor side detects 16° C., the fan 5 rotates so that the air sucked from the suction and exhaust port 2 on the ceiling side comes down in the ducts 4*a* and is exhausted from the suction and exhaust ports 3 on the floor side.

As a result, the temperature of the air on the floor side rises, and the indoor air can be efficiently temperature-controlled by convection.

As described above, as a result of temperature control, when the indoor temperature becomes 17° C. and there is no temperature difference (not larger than 1° C.) between the temperature detected by the upper temperature sensor and the temperature detected by the lower temperature sensor, the first control unit outputs an instruction for stopping the fan, and thus, the fan 5 stops.

On the other hand, when the temperature sensor in the air conditioner 16, which is set as a heater, detects 17° C., the air conditioner 16 starts due to the output of the control unit in the air conditioner 16 to thereby blow humidified air (for example, 25° C.) into the room.

In this manner, when the humidified air is blown into the room, the humidified air goes up towards the ceiling while warming the nearby air. When the humidified air is accumulated in the vicinity of the ceiling, the temperature near the ceiling becomes, for example, 22° C. As a result, since there is a big difference between the temperature on the floor side, that is 17° C., and the temperature near the ceiling, the fan 5 starts again.

As described above, the indoor air is circulated so that the room temperature rises quickly up to about 19° C., and when the temperature difference between the temperature that is detected by the upper temperature sensor and the temperature detected by the lower temperature sensor becomes not larger than 1° C., the fan 5 stops.

Also, in this case, since the indoor temperature is 19° C. and since 19° C. is lower than the set indoor temperature, 20° C., the air conditioner 16 continues to exhaust warm air of 25° C.

When the temperature sensor on the ceiling side detects 21° C., the fan 5 starts again since the temperature sensor on the floor side has detected 19° C.

In this manner, the room temperature, which has been 16° C. initially, sequentially rises to 18° C. and then 19° C. with substantially no temperature difference between the upper and lower parts of the room, and when the room temperature reaches the set indoor temperature, 20° C., the air conditioner 16 also stops.

Here, for example, if the temperature of the indoor temperature adjacent to the window drops, the air falls and is accumulated on the floor side, and becomes, for example, 19° C.

In this case, since the temperature on the ceiling side is 20° C., the temperature difference becomes 1° C. The fan 5 starts due to the output from the control unit so as to suck the upper air and blow the upper air downwards, and thus, the indoor air is averaged quickly (for example, 19.5° C.). As a result, the air conditioner 16 starts so as to blow the humidified air of 25° C. again to thereby increase the temperature of the indoor air, and when the temperature becomes 20° C., the air conditioner 16 stops.

In the above case, the output to the fan 5 can be changed for a case where the temperature difference between the upper temperature sensor and the lower temperature sensor is 4° C., and for a case where the temperature difference there between is 1° C. For example, when the temperature difference is 5° C., the fan 5 is rotated with 100% output, but when the temperature is 1° C., the fan 5 is rotated with 20% output. Similarly, when the room temperature is 5° C. lower than the set indoor temperature, the air conditioner 16, being set as a heater, is operated at 100% full capacity, but when the room temperature is lower than the set indoor temperature only by 1° C., the air conditioner 16 is operated at 20% output.

In this manner, a loss of energy which is caused by high-temperature air accumulating on the ceiling side and low-temperature air accumulating on the floor side can be prevented. At the same time, the air conditioner is efficiently operated, thereby enabling reasonable adjustment of the room temperature. Further, the room temperature can be adjusted while saving energy by controlling and using the output of the fan and the air conditioner in the range from 100% to 20%.

As described above, energy saving of about 15 to 25% can be achieved, by vertically circulating the indoor air, and by using the air conditioner, which is operated when the indoor temperature is away from the predetermined set indoor temperature. Moreover, energy saving of about 15 to 5% can be achieved by operation control for adjusting the output of the fan and the air conditioner.

Third Embodiment

Figure 7A:
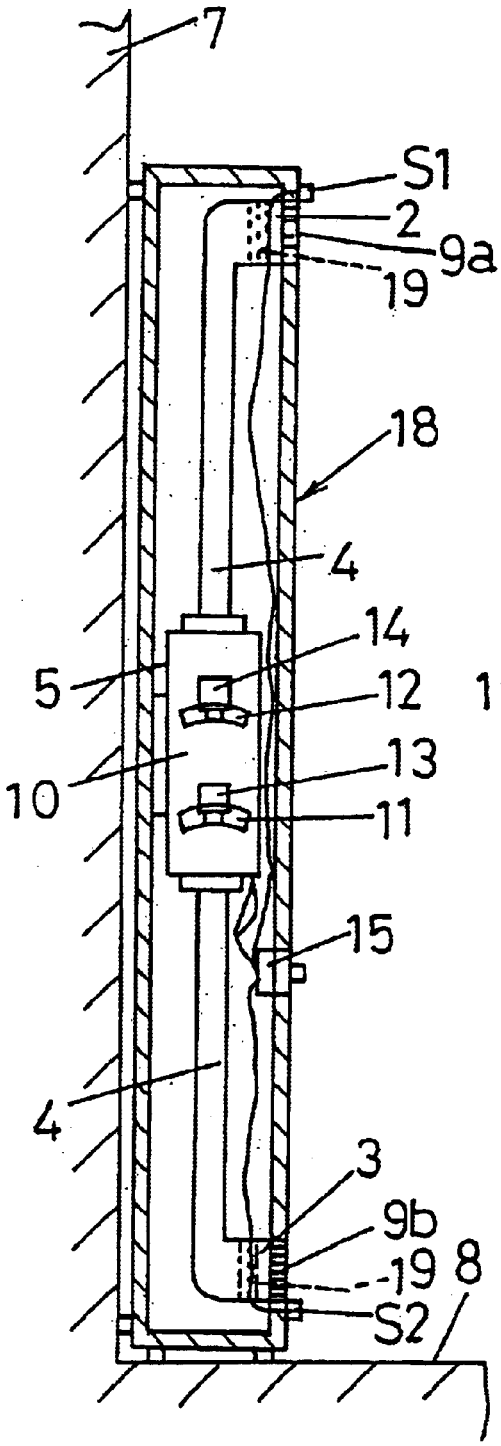
FIG. 7A is a longitudinal sectional view for explaining a third embodiment of indoor air vertical convection producing means, with a part thereof omitted.
Figure 7B:
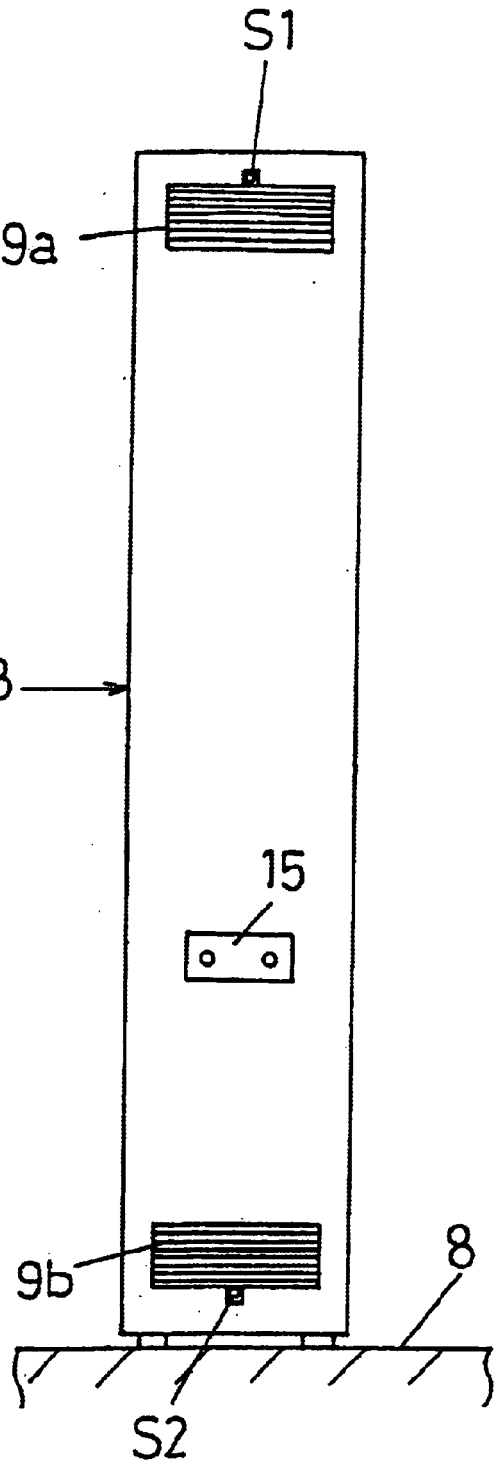
FIG. 7B is an front elevational view of FIG. 7A.

In the third embodiment of the present invention, the indoor air vertical convection producing means described above in the second embodiment is housed in one housing 18, and thus, indoor construction work is not necessary. Further, the above-described housing 18 of the indoor air vertical convection producing means may be a movable type, which is arranged on the floor 8 in the room (FIGS. 7A and 7B).

The above-described construction is such that an upper suction and exhaust grill 9*a* and a lower suction and exhaust grill 9*b* are provided on the upper and lower positions of the housing 18, respectively. The upper suction and exhaust grill 9*a* is the upper suction and exhaust port 2, and the lower suction and exhaust grill 9*b* is the lower suction and exhaust port 3. Further, a duct 4 is vertically provided for connecting the upper and lower suction and exhaust ports 2 and 3. A fan 5 that can change over the normal rotation and reverse rotation is provided in the middle of the duct 4. Moreover, an upper temperature sensor S1 is provided on the upper part of the housing 18, and a lower temperature sensor S2 is provided on the lower part of the housing 18.

In such a construction, the height of the housing 18 and the length of the duct 4 should be designed based on the height of the ceiling of the indoor space in which the housing is to be installed. When the height of the housing 18 is high, overturning can be prevented by fixing the housing 18 on the wall or the like.

In this construction, the upper temperature sensor S1 and the lower temperature sensor S2 may be provided near the ceiling 6 and near the floor 8 of the room, respectively, such that the respective temperature sensors are guided by wiring to a controller 15 which is provided in the housing 18.

A filter 19 is detachably provided inside of the upper and lower suction and exhaust grills 9*a* and 9*b* so as to remove dust and dirt in the room and to supply clean air.

In the above-described construction, the duct 4 is a dual-purpose type of duct that is provided for both warm wind and cold wind. At the time of heating in the wintertime, when the upper temperature sensor S1 and the lower temperature sensor S2 detect a temperature difference, the fan 5 rotates so as to flow air from the upper part to the lower part. As a result, the warm air that has accumulated on the upper part of the room is sucked from the upper suction and exhaust port 2 in the upper suction and exhaust grill 9*a*, and the accumulated warm air is exhausted as warm wind from the suction and exhaust port 3 in the lower suction and exhaust grill 9*b* so as to warm the floor 8 side. As a result, the overall indoor temperature can be made uniform efficiently.

Further, at the time of cooling in the summertime, when the upper temperature sensor S1 and the lower temperature sensor S2 detect a temperature difference, the fan 5 rotates so as to flow air from the lower part to the upper part. As a result, the cold air that has accumulated on the lower part of the room is sucked from the lower suction and exhaust port 3 in the lower suction and exhaust grill 9*b*, and the accumulated cool air is exhausted from the suction and exhaust port 2 in the upper suction and exhaust grill 9*a* as cold wind so as to cool the ceiling 6 side. As a result, the overall indoor temperature can be made uniform efficiently.

In the third embodiment, only the vertical convection in the indoor air has been described. In the third embodiment, however, when an existing air conditioner 15 has been already installed in the room and the vertically averaged room temperature is different from the set indoor temperature as a result of the vertical convection in the indoor air, the air conditioner 16 is automatically driven, as described above in the first embodiment.

In this case, the operation and effect is the same as in the first embodiment whereby a large amount of energy saving can be achieved by adjusting the output of the fan 5 and the air conditioner 16, the driving force of the fan motor and the generated quantity of heat of the air conditioner (exothermic and endothermic) based on the size of a difference between (1) the difference between the upper temperature and the lower temperature of the room which are actually detected by the upper temperature sensor S1 and the lower temperature sensor S2 and (2) the predetermined set temperature difference, and based on the size of a difference between the actual indoor temperature which is detected by the temperature sensor S3 (the third temperature sensor) and the predetermined set indoor temperature.

Figure 8:
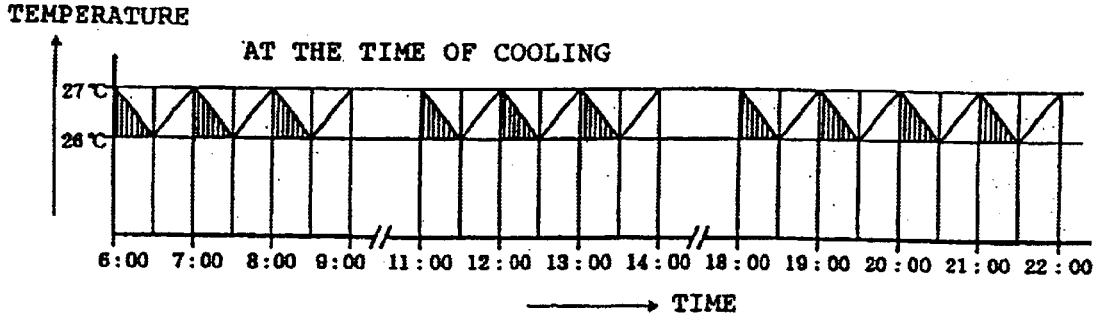
FIG. 8A is a graph for explaining the execution state of the apparatus of the present invention at the time of cooling.
FIG. 8B is a graph for explaining the execution state of the apparatus of the present invention at the time of heating.
Figure 8:
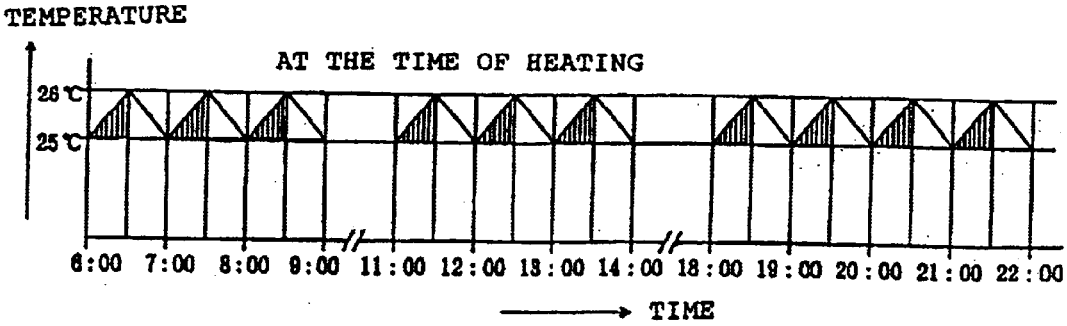

FIGS. 8A and 8B are graphs showing the execution state of the indoor air vertical convection producing means and the air conditioner when the above-described method and apparatus for saving energy in indoor air conditioning according to the present invention are used.

The indoor air vertical convection producing means was operated for 10 hours in total, from 6:00 to 9:00, from 11:00 to 14:004, and from 18:00 to 22:00 in a single day. In this case, at the time of cooling for decreasing the indoor temperature from 27° C. to 26° C., the oblique portions in FIG. 8A show the operated hour of the air conditioner, which is set as the cooling means. Moreover, at the time of heating for increasing the indoor temperature from 25° C. to 26° C., the oblique portions in FIG. 8B show the operating time of the air conditioner, which is set as the heating means. In other words, it can be confirmed that the operating time of the air conditioner has been reduced.

What is claimed is:

1. An energy saving method in indoor air conditioning, said method comprising:

vertically circulating indoor air by sucking or exhausting air from the upper and lower parts of a room depending on a temperature difference between the upper temperature and the lower temperature in the room; and operating or stopping an air conditioner equipped in the room depending on a temperature difference between the indoor temperature and a predetermined set indoor temperature;

wherein said sucking or exhausting of the air from the upper and lower parts of the room in said vertically circulating of the indoor air is increased or decreased based on the size of a difference between a detected temperature difference between the upper and lower parts of the room and a set temperature difference, and the energy quantity used in said operating the air conditioner is increased or decreased based on the size of a difference between the detected indoor temperature and the predetermined set indoor temperature.

2. An energy saving method in indoor air conditioning according to claim 1, wherein said sucking or exhausting of the air from the upper and lower parts of the room in said vertically circulating of the indoor air is carried out at a plurality of suction or exhaust points on the upper and lower parts of the room, detection of temperatures on the upper and lower parts of the room is carried out at the plurality of suction or exhaust points of the air, and an increase or decrease in a suction rate or exhaust rate of the air is carried out at the respective points where said sucking or exhausting of the air from the upper and lower parts of the room in said vertically circulating of the indoor air is carried out.

3. An energy saving method in indoor air conditioning, said method comprising:

vertically circulating indoor air by sucking or exhausting air from the upper and lower parts of a room depending on a temperature difference between the upper temperature and the lower temperature in the room; and operating or stopping an air conditioner equipped in the room depending on a temperature difference between the indoor temperature and a predetermined set indoor temperature;

wherein the upper temperature in the room is detected at one or a plurality of points near the ceiling, and the lower temperature in the room is detected at one or a plurality of points near the floor; and wherein said sucking or exhausting of the air from the upper and lower parts of the room in said vertically circulating of the indoor air is increased or decreased based on the size of a difference between a detected temperature difference between the upper and lower parts of the room and a set temperature difference, and the energy quantity used in said operating the air conditioner is increased or decreased based on the size of a difference between the detected indoor temperature and the predetermined set indoor temperature.

4. An energy saving method in indoor air conditioning according to claim 3, wherein said sucking or exhausting of the air from the upper and lower parts of the room in said vertically circulating of the indoor air is carried out at a plurality of suction or exhaust points on the upper and lower parts of the room, detection of temperatures on the upper and lower parts of the room is carried out at the plurality of suction or exhaust points of the air, and an increase or decrease of a suction rate or exhaust rate of the air is carried out at the respective points where said sucking or exhausting of the air from the upper and lower parts of the room in said vertically circulating of the indoor air is carried out.

5. An energy saving method in indoor air conditioning, said method comprising:

detecting an upper temperature and a lower temperature from the upper and lower parts of a room, respectively;

vertically circulating indoor air by sucking or exhausting air from the upper and lower parts of the room depending on a temperature difference between the detected upper temperature and the detected lower temperature in the room; and operating or stopping an air conditioner equipped in the room depending on a temperature difference between the indoor temperature and a predetermined set indoor temperature;

wherein said sucking or exhausting of the air from the upper and lower parts of the room in said vertically circulating of the indoor air is increased or decreased based on the size of a difference between a detected temperature difference between the upper and lower parts of the room and a set temperature difference, and the energy quantity used in said operating the air conditioner is increased or decreased based on the size of a difference between the detected indoor temperature and the predetermined set indoor temperature.

6. An energy saving method in indoor air conditioning according to claim 5, wherein said sucking or exhausting of the air from the upper and lower parts of the room in said vertically circulating of the indoor air is carried out at a plurality of points on the upper and lower parts of the room, said detecting of the upper temperature and the lower temperature on the upper and lower parts of the room is carried out at the plurality of suction or exhaust points of the air, and an increase or decrease of a suction rate or exhaust rate of the air is carried out at the respective points where said sucking or exhausting of the air from the upper and lower parts of the room in said vertically circulating of the indoor air is carried out.

7. An energy saving method in indoor air conditioning according to claim 5, wherein said detecting of the upper temperature and the lower temperature detects the upper temperature in the room at least at one point near the ceiling and the lower temperature in the room is detected at least at one point near the floor.

* * * * *

UNITED STATES PATENT AND TRADEMARK OFFICE

CERTIFICATE OF CORRECTION

PATENT NO. : 6,843,063 B2
DATED : January 18, 2005
INVENTOR(S) : Kazuo Miwa

It is certified that error appears in the above-identified patent and that said Letters Patent is hereby corrected as shown below:

Title page,
Item [22], PCT filing date, please replace "June 8, 2000" with -- June 8, 2001 --.
Item [30], Foreign Application Priority Data, please replace "June 8, 2001" with -- June 8, 2000 --.

Signed and Sealed this

Third Day of May, 2005

JON W. DUDAS
*Director of the United States Patent and Trademark Office*